US005959548A

United States Patent [19]

Smith

[11] Patent Number: 5,959,548

[45] Date of Patent: Sep. 28, 1999

[54] ELECTROMAGNETIC SIGNAL PICKUP DEVICE

[75] Inventor: Harrison C. Smith, Anna, Tex.

[73] Assignee: Halliburton Energy Services, Inc., Dallas, Tex.

[21] Appl. No.: 08/958,749

[22] Filed: Oct. 31, 1997

[51] Int. Cl.[6] ..... G01V 3/00

[52] U.S. Cl. ..... 340/854.8; 342/351

[58] Field of Search ..... 340/854.8; 324/338, 324/337, 98; 73/151.03; 343/719, 703; 342/351

[56] References Cited

U.S. PATENT DOCUMENTS

| | | | |
|---|---|---|---|
| 3,691,561 | 9/1972 | Jager | 343/727 |
| 3,947,770 | 3/1976 | Cavanaugh | 343/703 |
| 4,023,093 | 5/1977 | Aslan | 324/247 |
| 4,160,970 | 7/1979 | Nicolson | 340/18 |
| 4,502,009 | 2/1985 | Rodiere | 343/719 |
| 4,588,993 | 5/1986 | Babij | 342/351 |
| 4,651,100 | 3/1987 | Janes | 324/338 |
| 4,697,190 | 9/1987 | Oswald | 343/719 |
| 4,980,682 | 12/1990 | Klein et al. | 340/853 |
| 4,994,629 | 2/1991 | Tatum et al. | 174/6 |
| 5,026,508 | 6/1991 | Tatum et al. | 252/502 |
| 5,080,773 | 1/1992 | Tatum et al. | 204/196 |
| 5,130,706 | 7/1992 | MacLeod et al. | 340/854.4 |
| 5,189,415 | 2/1993 | Shamada et al. | 340/854.6 |
| 5,231,346 | 7/1993 | Gassmann | 324/95 |
| 5,512,824 | 4/1996 | Zdenek | 324/258 |
| 5,530,358 | 6/1996 | Wisler | 324/338 |
| 5,576,703 | 11/1996 | MacLeod et al. | 340/854.8 |

*Primary Examiner*—Michael Horabik
*Assistant Examiner*—Albert K. Wong
*Attorney, Agent, or Firm*—Paul I. Herman; Lawrence R. Youst

[57] ABSTRACT

An electromagnetic pickup device (64) for receiving electromagnetic signals (62) is disclosed that comprises an H-field probe (68) having an end (78) the is insertable into the earth (16) for receiving the H-field component of the electromagnetic signal (62) and a plurality of E-field probes (66) that are radially disposed about the H-field probe (68) and electrically isolated from the H-field probe (68), each having an end (76) that is insertable into the earth (16) for receiving the E-field component of the electromagnetic signal (62).

15 Claims, 2 Drawing Sheets

ELECTROMAGNETIC SIGNAL PICKUP DEVICE

TECHNICAL FIELD OF THE INVENTION

This invention relates in general to downhole telemetry and, in particular to, a electromagnetic signal pickup device for receiving electromagnetic signals carrying information from downhole equipment.

BACKGROUND OF THE INVENTION

Without limiting the scope of the present invention, its background is described in connection with transmitting downhole data to the surface during measurements while drilling (MWD), as an example. It should be noted that the principles of the present invention are applicable not only during drilling, but throughout the life of a wellbore including, but not limited to, during logging, testing, completing and producing the well.

Heretofore, in this field, a variety of communication and transmission techniques have been attempted to provide real time data from the vicinity of the bit to the surface during drilling. The utilization of MWD with real time data transmission provides substantial benefits during a drilling operation. For example, continuous monitoring of downhole conditions allows for an immediate response to potential well control problems and improves mud programs.

Measurement of parameters such as bit weight, torque, wear and bearing condition in real time provides for a more efficient drilling operations. In fact, faster penetration rates, better trip planning, reduced equipment failures, fewer delays for directional surveys, and the elimination of a need to interrupt drilling for abnormal pressure detection is achievable using MWD techniques.

At present, there are four major categories of telemetry systems that have been used in an attempt to provide real time data from the vicinity of the drill bit to the surface, namely mud pressure pulses, insulated conductors, acoustics and electromagnetic waves.

In a mud pressure pulse system, the resistance of mud flow through a drill string is modulated by means of a valve and control mechanism mounted in a special drill collar near the bit. This type of system typically transmits at 1 bit per second as the pressure pulse travels up the mud column at or near the velocity of sound in the mud. It has been found, however, that the rate of transmission of measurements is relatively slow due to pulse spreading, modulation rate limitations, and other disruptive limitations such as the requirement of mud flow.

Insulated conductors, or hard wire connection from the bit to the surface, is an alternative method for establishing downhole communications. This type of system is capable of a high data rate and two way communication is possible. It has been found, however, that this type of system requires a special drill pipe and special tool joint connectors which substantially increases the cost of a drilling operation. Also, these systems are prone to failure as a result of the abrasive conditions of the mud system and the wear caused by the rotation of the drill string.

Acoustic systems have provided a third alternative. Typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission.

The fourth technique used to telemeter downhole data to the surface uses the transmission of electromagnetic waves through the earth. A current carrying downhole data are input to a toroid or collar positioned adjacent to the drill bit or input directly to the drill string. An electromagnetic receiver is inserted into the ground at the surface where the electromagnetic data is picked up and recorded. It has been found, however, that in offshore applications, the boundary between the sea and the sea floor has a nonuniform and unexpected electrical discontinuity. Conventional electromagnetic systems are, therefore, unable to effectively pickup or receive the electromagnetic signals at the boundary between the sea and the sea floor. Additionally, it has been found that conventional electromagnetic systems are unable to effectively transmit the electromagnetic signals through sea water because of the boundary layer between the sea and air.

Therefore, a need has arisen for a system that is capable of telemetering real time data from the vicinity of the drill bit in a deep or noisy well using electromagnetic waves to carry the information to the sea floor or to the surface. A need has also arisen for an electromagnetic signal pickup device capable of receiving an electromagnetic signal at the sea floor and transmitting the information carried in the electromagnetic signals through the sea water to the surface.

SUMMARY OF THE INVENTION

The present invention disclosed herein comprises a electromagnetic signal pickup device that receives electromagnetic signals carrying information. The apparatus of the present invention provide for real time communication between downhole equipment and the surface using electromagnetic waves to carry information. The apparatus of the present invention allows for the pickup of an electromagnetic signal at the sea floor and allows the information in the electromagnetic signal to be transmitted to the surface.

The present invention comprises an electromagnetic pickup device for receiving electromagnetic signals that includes an H-field probe and a plurality of E-field probes. The H-field probe has an end that is inserted into the sea floor to receive the H-field component of the electromagnetic signal. The H-field probe may include one or more magnetometers.

The E-field probes are radially disposed about the H-field probe and are electrically isolated from the H-field probe. For example, four E-field probes may be positioned radial about the H-field probe at about 90 degree increments. The E-field probes each have an end that is inserted into the sea floor to receive the E-field component of the electromagnetic signal.

The electromagnetic pickup device may include one or more insulated rings and an insulated cradle for supporting the H-field probe and the E-field probes and for providing electrical isolation between the E-field probes and the H-field probe. The electromagnetic pickup device may also include an E-field wireline cable electrically connected to the E-field probes and an H-field wireline cable electrically connected to the H-field probe.

The E-field wireline cable is used to transmit the information carried in the E-field component of the electromagnetic signal from the electromagnetic pickup device to the surface. The H-field wireline cable is used to transmit the information carried in the H-field component of the electromagnetic signal from the electromagnetic pickup device to the surface. The electromagnetic pickup device of the present invention may therefore transmit the information carried in the E-field component, information carried in the H-field component or both to the surface.

In another embodiment of the present invention, an electromagnetic pickup device includes a weighted probe and a plurality of E-field probes. The weighted probe has an end that may be inserted into the sea floor and has a center of gravity that is proximate that end.

The E-field probes may be disposed generally radially about the weighted probe. The E-field probes each have an end that is inserted into the sea floor to receive the E-field component of the electromagnetic signal. The information carried in the electromagnetic signal may then be transmitted to the surface using an E-field wireline cable that is electrically connected to the E-field probes.

Additionally, this embodiment of the electromagnetic pickup device of the present invention may serve as a downlink to transmit information from the surface to downhole equipment. A wireline cable may transmits a current carrying information from the surface to the sea floor. The weighted probe of the electromagnetic pickup device then radiates electromagnetic waves into the earth to, for example, operate downhole equipment.

In both embodiments, the center of gravity of the electromagnetic pickup device is near the end of the H-field probe or the weighted probe, respectively, such that the electromagnetic pickup device will be self orienting with the ends of the E-field probes and the end of the H-field probe or the weighted probe pointing toward the sea floor as the electromagnetic pickup device travels downwardly in the sea during installation. The weight of the electromagnetic pickup device allows the ends of E-field probes and the end of H-field probe or the weighted probe to penetrate the sea floor upon impact.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
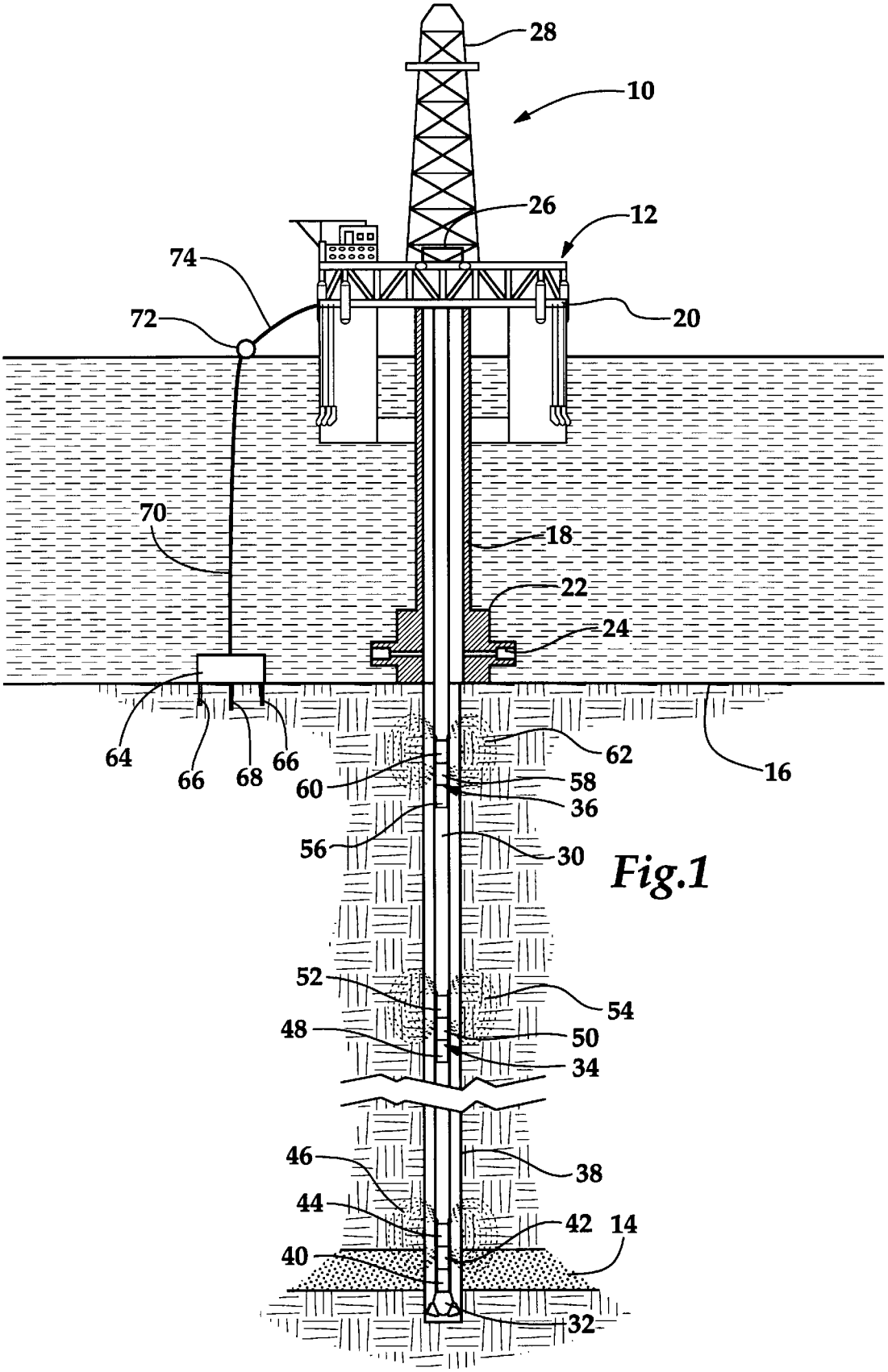
FIG. 1 is a schematic illustration of an offshore oil or gas drilling platform operating an electromagnetic signal pickup device of the present invention.

Referring to FIG. 1, an electromagnetic signal pickup device in use during an offshore drilling operation is schematically illustrated and generally designated 10. A semi-submergible platform 12 is centered over a submerged oil and gas formation 14 located below sea floor 16. A subsea conduit 18 extends from deck 20 of platform 12 to a wellhead installation 22 including blowout preventers 24. Platform 12 has a derrick 26 and a hoisting apparatus 28 for raising and lowering drill string 30, including drill bit 32 and electromagnetic signal repeaters 34, 36.

In a typical drilling operation, drill bit 32 is rotated by drill string 30, such that drill bit 32 penetrates through the various earth strata, forming wellbore 38. Measurement of parameters such as bit weight, torque, wear and bearing conditions of drill bit 32 may be obtained by sensors 40 located in the vicinity of drill bit 32. Additionally, parameters such as pressure and temperature as well as a variety of other environmental and formation information may be obtained by sensors 40. The signal generated by sensors 40 may typically be in the form of pulse width data, or the like, which must be converted to digital data before electromagnetic transmission in the present system. The signal generated by sensors 40 is passed into an electronics package 42 including an analog to digital converter which converts the analog signal to a digital code utilizing "1" and "0" for information transmission.

Electronics package 42 may also include electronic devices such as an on/off control, a modulator, a microprocessor, memory and amplifiers. Electronics package 42 is powered by a battery pack which may include a plurality of nickel cadmium or lithium batteries which are configured to provide proper operating voltage and current.

Once the electronics package 42 establishes the frequency, power and phase output of the information, electronics package 42 feeds the information to transmitter 44. Transmitter 44 may be a direct connect type transmitter that utilizes an output voltage applied between a two electrical terminals that are electrically isolated from one another to generate electromagnetic wave fronts 46. Electromagnetic wave fronts 46 radiate into the earth carrying the information obtained by sensors 40.

Alternatively, transmitter 44 may include a magnetically permeable annular core, a plurality of primary electrical conductor windings and a plurality of secondary electrical conductor windings which are wrapped around the annular core. Collectively, the annular core, the primary windings and the secondary windings serve to approximate an electrical transformer which generates electromagnetic wave fronts 46. The information obtained by sensors 40 is then carried uphole in the form of electromagnetic wave fronts 46 which travel through the earth.

Electromagnetic wave fronts 46 are picked up by a receiver 48 of repeater 34 located uphole from transmitter 44. Receiver 48 of repeater 34 is spaced along drill string 30 to receive the electromagnetic wave fronts 46 while electromagnetic wave fronts 46 remain strong enough to be readily detected. Receiver 48 may electrically approximates a large transformer having a magnetically permeable magnetic core, a plurality of primary electrical conductor windings wrapped therearound and a plurality of secondary electrical conductor windings also wrapped therearound. As electromagnetic wave fronts 46 reach receiver 48, a current is induced in receiver 48 that carries the information originally obtained by sensors 40.

The current is fed to an electronics package 50 that may include a variety of electronic devices for cleaning up and amplifying the signal to reconstruct the original waveform, compensating for losses and distortion occurring during the transmission of electromagnetic wave fronts 46 through the earth.

Electronics package 50 is coupled to a transmitter 52 that radiates electromagnetic wave fronts 54 into the earth in the manner described with reference to transmitter 44 and electromagnetic wave fronts 46. Electromagnetic wave fronts 54 travel through the earth and are eventually picked up by a receiver 56 of repeater 36. Repeater 36 includes receiver 56, electronics package 58, and transmitter 60 each of which operate in a manner as described with reference to repeater 34, receiver 48, electronics package 50, and transmitter 52. Thus, after electromagnetic wave fronts 54 are received by receiver 56 and processed by electronics package 58, the information is passed to transmitter 60 that radiates electromagnetic wave fronts 62 into the earth.

Electromagnetic wave fronts 62 travel through the earth and are received by electromagnetic pickup device 64 located on sea floor 16. Electromagnetic pickup device 64 may detect either the electrical field (E-field) component of electromagnetic wave front 62, the magnetic field (H-field) component of electromagnetic wave fronts 62 or both using E-field probes 66 and an H-field probe 68 or both. Electromagnetic pickup device 64 serves as a transducer transforming electromagnetic wave front 62 into an electric signal. The electric signal may be sent to the surface on one or more wirelines 70 that are attached to buoy 72 and onto platform 12 via wireline 74 for further processing. Upon reaching platform 12, the information originally obtained by sensors 40 is further processed making any necessary calculations and error corrections such that the information may be displayed in a usable format.

Even though FIG. 1 depicts two repeaters 34, 36, it should be noted by one skilled in the art that the number of repeaters located within drill string 30 will be determined by the depth of wellbore 38 and the characteristics of the earth's strata adjacent to wellbore 38 in that electromagnetic waves suffer from attenuation with increasing distance from their source at a rate that is dependent upon the composition characteristics of the transmission medium. For example, repeaters 34, 36 may be positioned between 3,000 and 5,000 feet apart. Thus, if wellbore 38 is 15,000 feet deep, between two and four repeaters such as repeaters 34, 36 would be desirable. Alternatively, it should be noted that repeaters 34, 36 may not be necessary in a shallow well where electromagnetic wave fronts 46 from transmitter 44 remain strong enough to be readily detected by electromagnetic pickup device 64.

Even though FIG. 1 depicts electromagnetic pickup device 64 in an offshore environment, it should be understood by one skilled in the art that electromagnetic pickup device 64 is equally well-suited for operation in an onshore environment. In fact, in an onshore environment, electromagnetic pickup device 64 would be placed directly on the land surface without the need for buoy 72.

Additionally, while FIG. 1 has been described with reference to transmitting information uphole during a measurement while drilling operation, it should be understood by one skilled in the art that electromagnetic pickup device 64 may be used throughout the life of wellbore 38, for example, during logging, testing, completing and producing the well.

Further, even though FIG. 1 has been described with reference to one way communication from the vicinity of drill bit 32 to platform 12, it should be understood by one skilled in the art that the principles of the present invention are applicable to two way communication. For example, a surface installation may be used to request downhole pressure, temperature, or flow rate information from formation 14 by sending electromagnetic wave fronts downhole which may be amplified as described above with reference to repeaters 34, 36. Sensors, such as sensors 40, located near formation 14 receive this request and obtain the appropriate information which would then be returned to the surface via electromagnetic wave fronts which may again be amplified as described above with reference to repeaters 34, 36 and would be picked up by electromagnetic pickup device 46.

Figure 2:
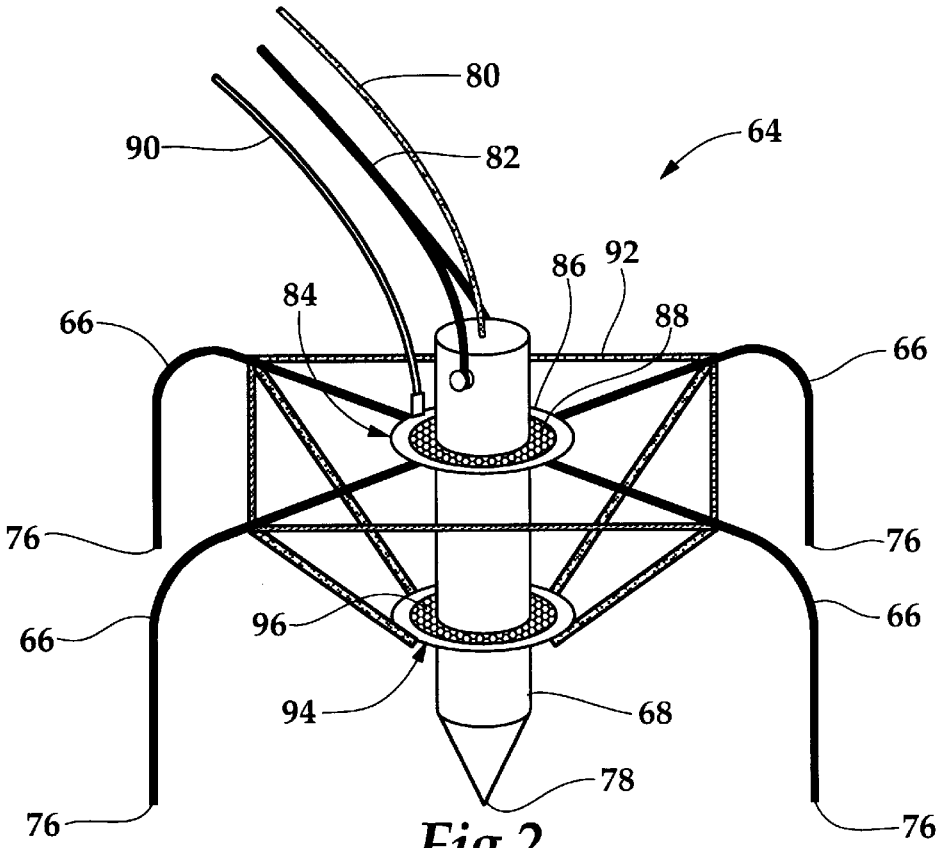
FIG. 2 is a perspective view of one embodiment of an electromagnetic pickup device of the present invention.

FIG. 2 is a perspective representation of an electromagnetic pickup device 46 of the present invention. Electromagnetic pickup device 64 includes a plurality of E-field probes 66 and an H-field probe 68. E-field probes 66 may be constructed from a conductive rod or tubing including metals such as steel, copper or a copper clad. E-field probes 66 each have an end 76 that inserted through sea floor 16 to extend into the earth such that electromagnetic wave fronts, such as electromagnetic wave fronts 62 of FIG. 1, may be received by E-field probes 66 without crossing the boundary between the sea and sea floor 16. E-field probe 66 pickup the E-field component of electromagnetic wave fronts 62.

H-field probe 68 of electromagnetic pickup device 64 has an end 78 that is inserted through sea floor 16 into the earth such that electromagnetic wave fronts 62 are received by H-field probe 68 before electromagnetic wave fronts 62 cross through the boundary of sea floor 16 and the sea. H-field probe 68 includes one or more magnetometers for detecting the H-field component of electromagnetic wave fronts 62. The information carried in the H-field component is obtained by H-field probe 68 and transmitted to the surface in H-field wireline cable 80. Also, electromagnetic pickup device 64 may include a safety lanyard 82 that may be connected to, for example, H-field probe 68.

Electromagnetic pickup device 64 includes an insulated ring 84 that attaches E-field probes 66 to H-field probe 68. Insulated ring 84 includes an electrically conductive ring 86 and a dielectric ring 88. The electrically conductive ring 86 is attached to E-field probes 66 to provide an electrically conductive path between E-field probes 66 and an E-field wireline cable 90. E-field wireline cable 90 transmits the current created in E-field probes 66 by electromagnetic wave fronts 62 from electromagnetic pickup device 64 to the surface. The dielectric ring 88 creates an non-conductive region between conductive ring 86 and H-field probe 68.

Electromagnetic pickup device 64 may include an insulated cradle 92 that is disposed between E-field probes 66 and H-field probe 68. Insulated cradle 92 provides structural support to E-field probes 66 to prevent relative translational or rotational motion between E-field probes 66 and H-field probe 68. Insulated cradle 92 may be attached to H-field probe 68 using an insulated ring 94 which may include a dielectric ring 96.

In operation, electromagnetic pickup device 64 may be lowered from platform 12, dropped from a boat using safety lanyard 82 or using a remote operated vehicle (ROV). As the electromagnetic pickup device 64 falls through the sea, electromagnetic pickup device 64 becomes correctly oriented with end 78 of H-field probe 68 and ends 76 of E-field probes 66 pointing toward sea floor 16. This orientation is achieved by having the center of gravity of electromagnetic pickup device 64 near end 78 of H-field probe 68. A computer located on platform 12 may be used to determine which component of electromagnetic wave fronts 62 is stronger to select whether the E-field component, the H-field component or both will be further processed to interpret the information carried therein.

Once electromagnetic pickup device 64 reaches sea floor 16, end 78 of H-field probe 68 and ends 76 of E-field probes 66 penetrate sea floor 16. E-field probes 66 and H-field probe 68 are now positioned to receive electromagnetic wave fronts such as electromagnetic wave front 62. Electromagnetic pickup device 64 may pick up the E-field component of electromagnetic wave fronts 62 using E-field probes 66 or the H-field component of electromagnetic wave fronts 62 using H-field probe 68. Alternatively, electromagnetic pickup device 64 may pickup the E-field component and the H-field component of electromagnetic wave fronts 62 using, respectively, E-field probes 66 and H-field probe 68. A computer located on platform 12 may be used to determine which component of electromagnetic wave fronts 62 is stronger to select whether the E-field component, the H-field component or both will be further processed to interpret the information carried therein.

Figure 3:
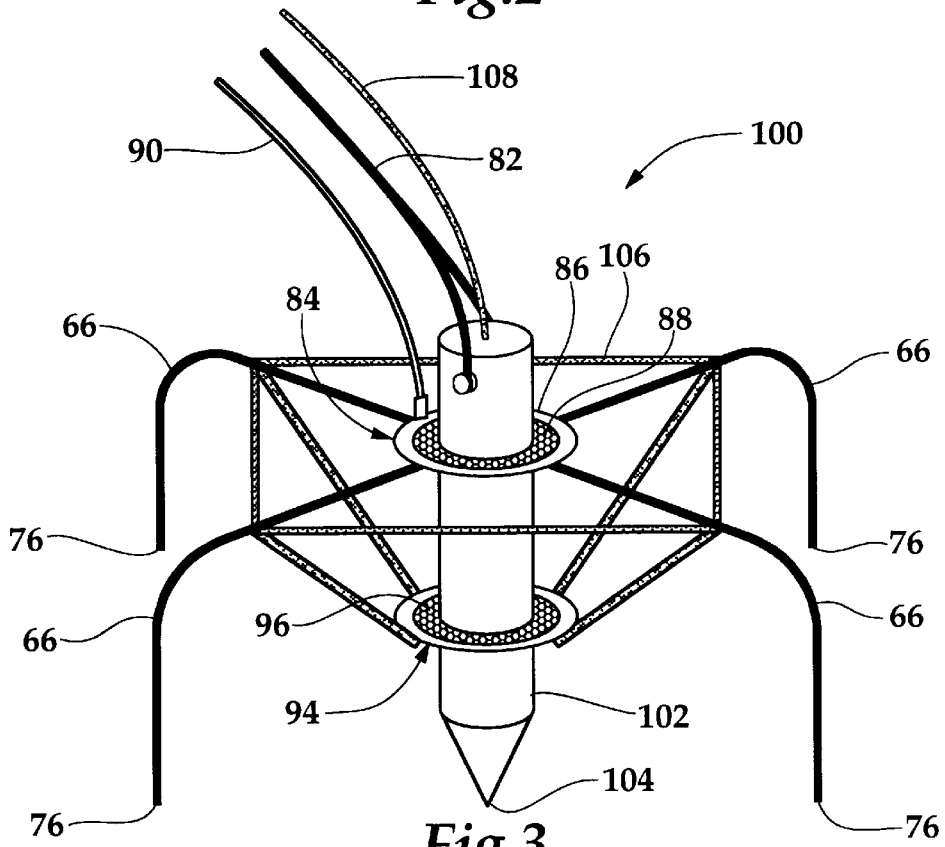
FIG. 3 is a perspective view of another embodiment of an electromagnetic pickup device of the present invention.

FIG. 3 is a perspective representation of another embodiment of an electromagnetic pickup device that is generally designated 100. Electromagnetic pickup device 100 includes a plurality of E-field probes 66 each having an end 76. Electromagnetic pickup device 100 also includes a weighted probe 102 that has an end 104. E-field probes 66 may be attached to weighted probe 102 by an insulated ring 84 having a conductive ring 86 and a dielectric ring 88. The conductive ring 86 is used to transmit the current created in E-field probes 66 by an electromagnetic wave front such as electromagnetic wave front 62 to E-field wireline cable 90. The current is transmitted to the surface from conductive ring 86 via E-field wireline cable 90.

Electromagnetic pickup device 100 may include a frame member 106 that provides structural support between weighted probe 102 and E-field probes 66 to prevent relative translational and rotational motion therebetween. Frame member 106 may be attached to weighted probe 102 using an insulated ring 94 which may include a dielectric ring 96.

In operation, electromagnetic pickup device 100 may be lowered from platform 12 or lowered from a boat using safety lanyard 82. As electromagnetic pickup device 100 travels through the sea, electromagnetic pickup device 100 becomes correctly oriented due to the low center of gravity of weighted probe 102 near end 104. Upon reaching sea floor 16, ends 76 of E-field probes 66 penetrate therethrough such that electromagnetic wave fronts 62 may be received by E-field probes 66 before passing through the boundary created between the sea and sea floor 16. Electromagnetic pickup device 100 may then receive the E-field component of electromagnetic wave fronts 62 in E-field probes 66. Additionally, electromagnetic pickup device 100 may be used as a downlink to transmit electromagnetic waves carrying information from the surface downhole. Wireline cable 108 is used to transmit a current to weighted probe 102, which, in this embodiment, is made from a conductive material. Electromagnetic waves carrying information are then radiated into the earth by weighted probe 102 to operate downhole equipment or to prompt sensors 40 to obtain information which will be transmitted uphole and picked up by electromagnetic pickup device 100.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An electromagnetic pickup device for receiving electromagnetic signals from the earth, the device comprising:

an H-field probe having an end that is inserted into the earth; and a plurality of E-field probes coupled with and electrically isolated from the H-field probe, each of the E-field probes having an end that is inserted into the earth.

2. The electromagnetic pickup device as recited in claim 1 further comprising an insulated ring providing an electrically isolated coupling between the H-field probe and the plurality of E-field probes.

3. The electromagnetic pickup device as recited in claim 1 further comprising an insulated cradle disposed between the H-field probe and the plurality of E-field probes providing electrical isolation between the plurality of E-field probes and the H-field probe.

4. The electromagnetic pickup device as recited in claim 3 further comprising an insulated ring providing an electrically isolated coupling between the H-field probe and the insulated cradle.

5. The electromagnetic pickup device as recited in claim 1 wherein the plurality of E-field probes are disposed generally radially about the H-field probe.

6. The electromagnetic pickup device as recited in claim 1 further comprising an E-field wireline cable electrically connected to the plurality of E-field probes.

7. The electromagnetic pickup device as recited in claim 1 further comprising an H-field wireline cable electrically connected to the H-field probe.

8. The electromagnetic pickup device as recited in claim 1 wherein the E-field component of the electromagnetic signal is picked up.

9. The electromagnetic pickup device as recited in claim 1 wherein the H-field component of the electromagnetic signal is picked up.

10. The electromagnetic pickup device as recited in claim 1 wherein the E-field component and the H-field component of the electromagnetic signal are picked up.

11. An electromagnetic pickup device for receiving electromagnetic signals comprising:

an H-field probe having an end that is insertable into the earth for receiving the H-field component of the electromagnetic signal;

a plurality of E-field probes radially disposed about the H-field probe wherein each of the E-field probes has an end that is insertable into the earth for receiving the E-field component of the electromagnetic signal; and an insulated ring disposed between the H-field probe and the plurality of E-field probes providing an electrically isolated coupling between the H-field probe and the plurality of E-field probes.

12. The electromagnetic pickup device as recited in claim 11 further comprising an insulated cradle disposed between the H-field probe and the plurality of E-field probes providing electrical isolation between the plurality of E-field probes and the H-field probe.

13. The electromagnetic pickup device as recited in claim 12 further comprising an insulated ring providing an electrically isolated coupling between the H-field probe and the insulated cradle.

14. The electromagnetic pickup device as recited in claim 11 further comprising an E-field wireline cable electrically connected to the plurality of E-field probes.

15. The electromagnetic pickup device as recited in claim 11 further comprising an H-field wireline cable electrically connected to the H-field probe.

* * * * *